United States Patent [19]

Lacroix

[11] 4,160,871

[45] Jul. 10, 1979

[54] CONNECTING DEVICE FOR ACHIEVING THE ELECTRICAL JUNCTION AND MECHANICAL ASSEMBLY OF AT LEAST TWO CONDUCTORS

[76] Inventor: Jacques Lacroix, 94 Elysee II, La Celle Saint Cloud, France, 78170

[21] Appl. No.: 766,904

[22] Filed: Feb. 9, 1977

[30] Foreign Application Priority Data

Feb. 17, 1976 [FR] France ..... 76 04300

[51] Int. Cl.[2] ..... H01R 5/10

[52] U.S. Cl. ..... 174/84 R; 24/136 R; 174/88 R; 174/91; 403/215; 403/314; 403/341

[58] Field of Search ..... 339/205, 244 R, 248 R, 339/248 S, 273 R, 273 F, 273 S, 198 H, 198 G; 403/206, 215, 216, 211, 314, 374, 341, 300, 339; 24/136 R, 136 L, 28, 115 R; 174/84 R, 84 S, 88 R, 88 S, 91

[56] References Cited

U.S. PATENT DOCUMENTS

| | | | |
|---|---|---|---|
| 155,535 | 9/1874 | Mason | 24/136 K |
| 242,388 | 5/1881 | Smith | 174/91 |
| 1,545,889 | 7/1925 | Everson | 24/136 R |
| 2,370,725 | 3/1945 | Gordon | 339/248 R |
| 2,989,723 | 6/1961 | Hopkins et al. | 339/213 R |
| 2,999,223 | 9/1961 | Peter | 339/205 |
| 3,140,520 | 7/1964 | Marino et al. | 403/211 |
| 3,358,266 | 12/1967 | Chandler et al. | 339/205 |
| 3,771,104 | 11/1973 | Clark | 339/198 G |
| 4,070,086 | 1/1978 | Trafford | 339/198 H |

FOREIGN PATENT DOCUMENTS

| | | | |
|---|---|---|---|
| 579732 | 7/1959 | Canada | 339/205 |
| 650153 | 1/1929 | France | 403/211 |
| 49327 | 9/1931 | Norway | 174/84 S |
| 266164 | 4/1950 | Switzerland | 403/215 |

*Primary Examiner*—Thomas J. Kozma

*Attorney, Agent, or Firm*—George B. Oujevolk

[57] ABSTRACT

The connecting device achieves the electrical junction and mechanical assembly of at least two thread-like single-strand or multi-strand conductors through the agency of a connecting member insulated by at least one slidable terminal which is at least partly dielectric and locked in position on said member after the union of the member with the conductors. The connecting member has at least two inputs and at least two orifices in which the bared ends of the conductors are engaged in the form of a labyrinth shape. The terminal covers the bared ends of the two conductors. The connecting device is applicable to the electrical installations of living quarters and industrial premises and to any machine supplied with electricity.

21 Claims, 15 Drawing Figures

Figure 1:
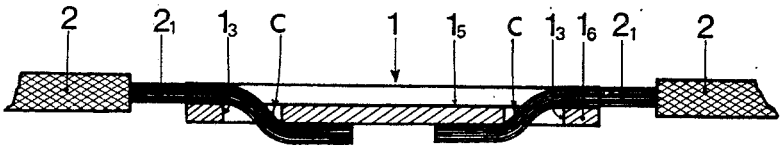

CONNECTING DEVICE FOR ACHIEVING THE ELECTRICAL JUNCTION AND MECHANICAL ASSEMBLY OF AT LEAST TWO CONDUCTORS

The invention relates to a connecting device for achieving the electrical junction and mechanical assembly of at least two thread-like single-strand or multi-strand conductors by means of a connecting member which is insulated by at least one slidable terminal which is locked in position on said member after the union of the latter with the conductors.

Such connecting devices are known and comprise an electrically conductive connecting member and at least one terminal of dielectric material which insulates the connection zone.

Such devices, disclosed in particular in French patent No. 1,581,541 of May 22, 1968, are constituted by insulating terminals having the feature of comprising a tubular guide in which one of the two conductors to be interconnected is slidable, this guide being associated with a contiguous sleeve or sheath located in a plane parallel to the guide and extending over at least a part of its length, so that the bared end of the considered conductor coming from the tubular guide is folded as a hairpin at 180° in the contiguous sleeve, which, depending on its section, receives the flat plug or cylindrical pin which is clipped on the end of the second conductor. In certain cases, the sleeve may have a section which is compatible with its assembly with another terminal connected to the second conductor and whose shape is complementary to the bore of the sleeve. Thus, in all cases, the electrical junction is achieved by folding the bared end of a conductor at 180° and by application of the connecting member, integral with the second conductor, on said folded end.

This device is without any doubt a considerable improvement over the prior art but has however a few major drawbacks. Indeed, this device has no resistance to a pulling force, which excludes any guarantee against any pulling apart. Now, the undesired disconnection of conductors constitutes a real danger, and this device is unreliable and cannot be employed with complete safety. Moreover, the insulation of the connection is not absolutely satisfactory, which is in contradiction with the strict standards imposed in this field.

An object of the invention is to overcome these drawbacks and relates to a connecting device which permits achieving simply, with no use of a tool and with complete safety, the electrical junction and the mechanical assembly of at least two conductors, this device being perfectly insulated and having a good mechanical resistance to pulling apart.

According to the invention, there is provided a connecting device for achieving the electrical junction and the mechanical assembly of at least two single-strand or multi-strand conductors of various gauges, said device comprising a connecting member having at least two inputs provided with at least two orifices in which the bared ends of the conductors are engaged in the shape of labyrinths, and at least one tubular at least partly dielectric terminal, the latter being locked on the connecting member and covering the bared ends of said two conductors.

According to a preferred embodiment, the connecting member is in the form of an electrically conductive tongue member half of which is engaged in two insulating terminals in end-to-end abutting relation, said two terminals covering the connection zone.

According to another embodiment, the tongue member is in the form of a flat metal strip the two ends of which are provided with an orifice having a diameter slightly greater than that of the bared end of the conductors, said strip having on its two lateral sides locking notches which cooperate with complementary bosses which project from the interior of the tubular connecting terminals.

According to a feature of the invention, the tubular terminals are constituted by insulating cylindrical sleeves the bore of which is provided with inner shoulders which extend longitudinally in a substantially diametral plane of the cylinder, said shoulders resulting from the difference between the radii of two semi-diameters of the bore, the semi-diameter having the larger radius extending only in a part of the length of the sleeve so as to constitute a radial abutment which limits the depth of insertion of the connecting member.

In one modification, the connecting terminals have a substantially parallel-sided shape and a bore of rectangular section, the width of which is equal to that of the connecting member, and the bottom wall of which is slightly incurvate in a transverse plane and curved in the region of its edge connected with the front end face of the terminal.

Figure 2:
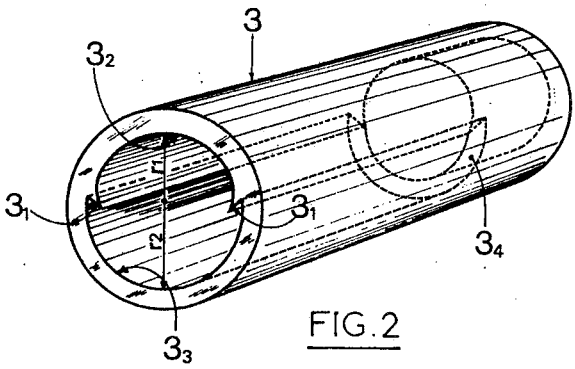
Figure 3:
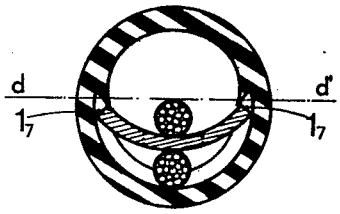
Figure 4:
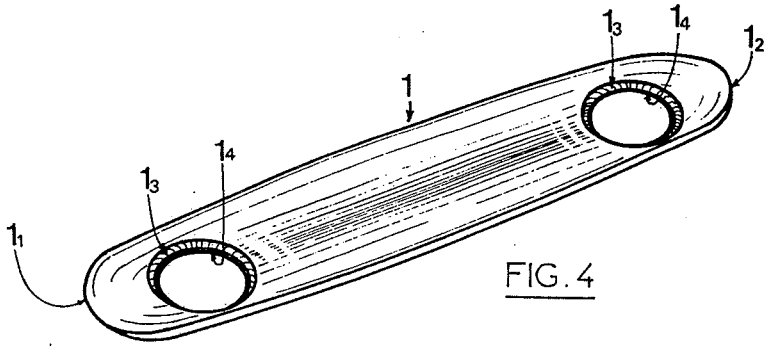
Figure 5:
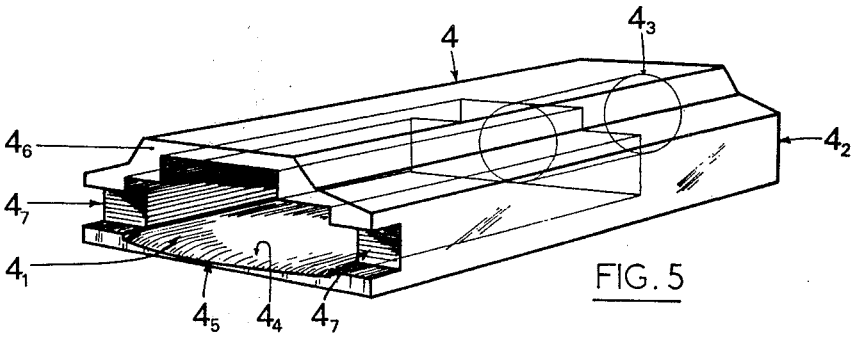
Figure 6A:
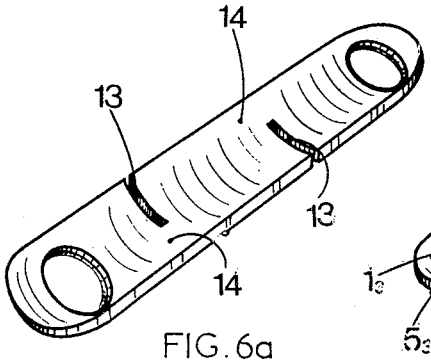
Figure 6B:
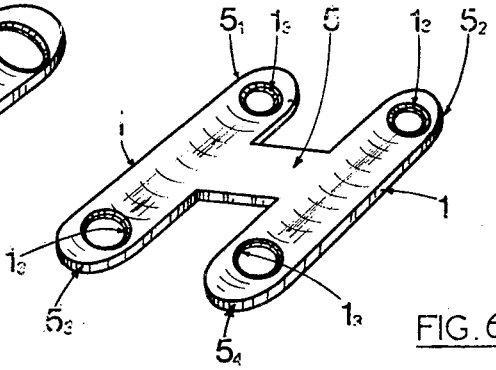
Figure 7:
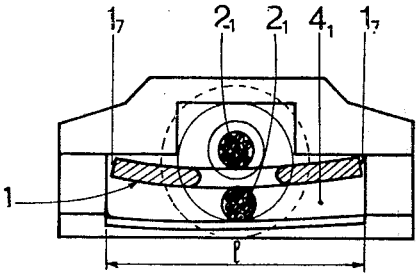
Figure 8:
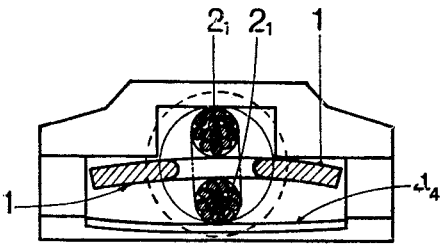
Figure 9:
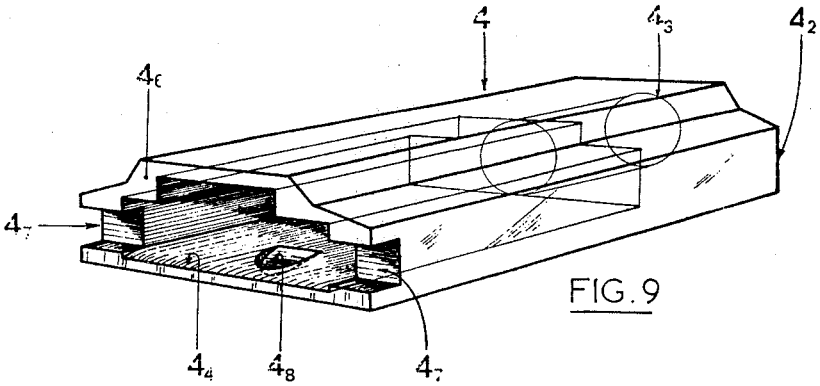
Figure 10:
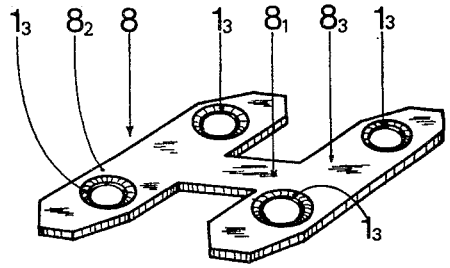
Figure 11:
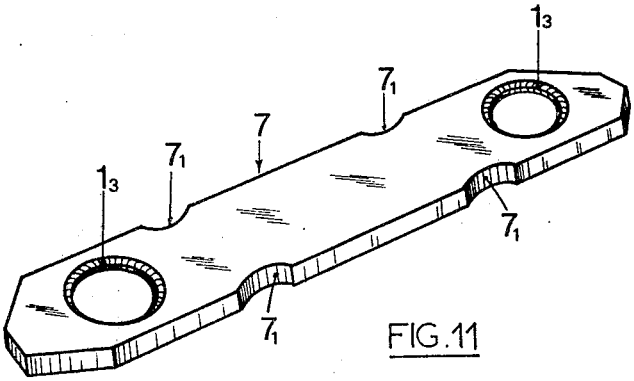
Figure 12:
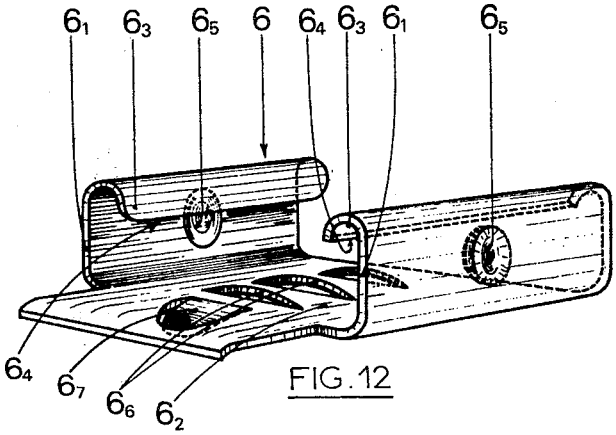
Figure 13:
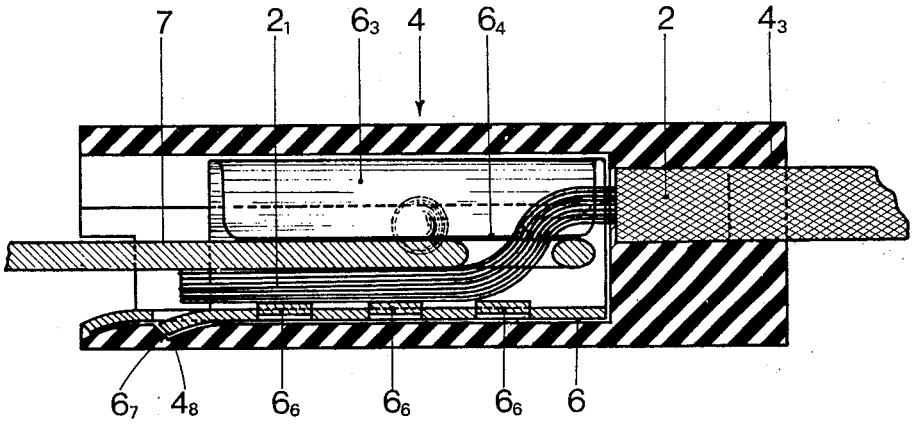
Figure 14:
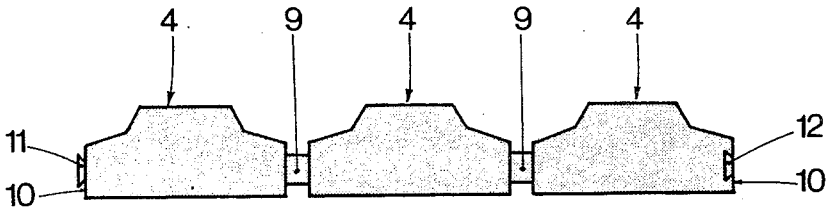

A connecting device according to the invention is shown by way of an example, to which the invention is not intended to be limited, in the following figures in which:

FIG. 1 is a diagrammatic view showing the electrical junction of two conductors by means of a connecting member according to the invention, FIG. 2 is a perspective view of an insulating terminal according to a first embodiment, FIG. 3 is a cross-sectional view of the terminal illustrated in FIG. 2, after assembly with the connecting member illustrated in FIG. 1, FIG. 4 is a perspective view of a connecting tongue member the use of which is reserved for weak currents, FIG. 5 is a perspective view of an insulating terminal according to a second embodiment, FIG. 6*a* is a perspective view of a connecting tongue member according to a modification, FIG. 6*b* is a perspective view of a connecting tongue member having four inputs, FIGS. 7 and 8 are cross-sectional views of the connecting device, after assembly of the terminal illustrated in FIG. 5 with the tongue member shown in FIG. 4, FIG. 9 is a perspective view of an insulating terminal according to a third embodiment, FIG. 10 is a perspective view of a connecting tongue member having a plurality of inputs intended for strong currents, FIG. 11 is a perspective view of a planar connecting tongue member also intended for strong currents, FIG. 12 is a perspective view of an auxiliary electrical conductive member intended to be inserted and locked in the insulating terminal illustrated in FIG. 9, FIG. 13 is an axial sectional view of the connecting device, after assembly of the terminal shown in FIG. 9, the auxiliary electrically conductive member shown in FIG. 12 and the tongue member shown in FIG. 11, FIG. 14 is a diagrammatic view of a group of three insulating terminals.

The essential purpose of the invention resides in the design of a connecting device which may be employed indifferently for weak or strong currents, for single-strand or multi-strand conductors, irrespective of their gauge.

This connecting device must moreover satisfy the standards required in this field and must consequently be highly reliable and provide an excellent electrical conduction and good insulation.

To this end, the device according to the invention is based on two distinct principles, on one hand, the use of bent connecting tongue members or strips of sheet material when it concerns weak current, which relates to FIGS. 1 to 8, and, on the other hand, the use of flat tongue members or strips of sheet material for strong currents, which relates to FIGS. 9 to 13. The first principle (FIGS. 1 to 8) comprises two different embodiments of the insulating terminal.

The connecting device, illustrated in FIGS. 1 to 4 and constituting the first embodiment of the invention, comprises three essential elements: a connecting member 1 adapted to form an electrical bridge between the two conductors 2 the junction of which is to be made, and two insulating terminals 3 in which half of the connecting member 1 will be engaged.

This connecting member is in the form of an electrically conductive tongue member or strip which is wholly or partly metallic, this tongue member being, for transmission of weak current, bent transversely as seen in FIGS. 3 and 4. This metal tongue member or strip has rounded ends $1_1$ and $1_2$ and is provided in the vicinity of its ends with two orifices $1_3$, the edges $1_4$ of which have been, by design, rounded so as to avoid penetrating the conductors by a shearing effect. The two orifices $1_3$ have a diameter slightly greater than that of the bared end $2_1$ of the conductors as illustrated in FIG. 1, so that these ends may be engaged in these orifices $1_3$ and then folded under the connecting member 1 so as to form a labyrinth or staggered shape C. Thus the bared end of each conductor is in electrical contact with the two opposed surfaces or sides $1_5$ and $1_6$ of the connecting member. This principle of electrical junction between the two conductors 2 is applicable to any type of single-strand or multi-strand conductor, although in the considered embodiment it concerns a multi-strand conductor. The connecting member 1 or tongue member provides the electrical junction, that is to say, ensures the conductibility between the two conductors, whereas the mechanical assembly of the latter is more particularly achieved by the insulating terminals 3.

These terminals are constituted, in the embodiment illustrated in FIGS. 2 and 3, by cylindrical sleeves or sheaths the bore of which has the feature of being provided with inwardly extending shoulders or abutment means $3_1$, these shoulders being rectilinear and extending longitudinally in a substantially diametral plane of the terminal. These shoulders are defined by the difference between the radii $r_1$ and $r_2$ of the two semi-diameters $3_2$ and $3_3$. As can be seen in FIG. 3, these shoulders are inclined with respect to the diametral plane d d' so as to ensure a better anchoring of the lateral edges $1_7$ of the connecting member. Further, the semi-diameter $3_3$ having the larger radius extends only in a part of the length of the sleeve constituting the terminal so as to define a radial abutment $3_4$ which limits the depth of insertion of the connecting member 1 in said terminal.

The radius $r_2$ of the semi-diameter $3_3$ of the bore of the terminal is substantially equal to twice the width of the connecting tongue member so that the terminal perfectly marries up with this tongue member and closely cooperates in the mechanical assembly of the conductors 2 which are trapped in this terminal and held stationary by their labyrinths C. Thus in being jammed by its lateral edges $1_7$ against the inner wall of the insulating terminals, the connecting member 1 provides both an excellent electrical junction between the conductors and a good mechanical assembly which resists pulling apart. Of course, the junction or contact zone seen in FIG. 1 is fully insulated by the two connecting terminals which are identical to that shown in FIG. 2, these two terminals being in end-to-end abutting relation and each covering one half of the connecting tongue member 1.

The connecting terminal may be made from an injection moulded dielectric material. It may also be made from a metallic terminal which is covered externally for example by moulding thereover an insulating sheath of dielectric material.

The tongue member may moreover (FIG. 6*a*) have transverse slots 13 which are alternately arranged on each of the longitudinal edges of the tongue member or strip. This type of tongue member is employed in connections in which two conductors of different sections must be interconnected. Indeed, the slots 13 facilitate the axial deformation of the tongue member and the latter can be deformed partly and locally in accordance with the gauge of the wire employed. Thus by a twisting about the pivot 14, one of the ends of the tongue member may be slightly raised whereas the other end to which the conductor of small diameter is connected remains unchanged.

According to a modification, the connecting terminal may not be cylindrical but have any other section. Thus that illustrated in FIG. 5 is in the form of a substantially parallel-sided block 4, the inner bore $4_1$ of which has a section similar to a rectangle. This bore does not extend throughout the terminal and opens onto the end face $4_2$ of said terminal by way of a circular orifice $4_3$. As can be seen more clearly in the assembly of FIGS. 7 and 8, this terminal has the feature of having a slightly concave bottom wall $4_4$ so as to improve the positioning of the conductors inside the terminal and in particular facilitate the centering thereof. Moreover, it will be seen in FIG. 5 that the edge $4_5$, which is connected with the front end face $4_6$ of the terminal, is curved so as to facilitate the mounting of the terminals on the connecting member.

This front end face $4_6$ may or may not have notches or recesses $4_7$ adapted for the passage of junction strips 5 interconnecting two connecting tongue members (FIG. 6*b*), which tongue members are employed in the case of branch connections. If, on the other hand, an assembly is required as a simple prolongation as illustrated in FIG. 1, the notches $4_7$ provided on the front end face $4_6$ of the terminal may be eliminated or unutilized.

This terminal 4, as opposed to the terminal shown in FIG. 2, is constructed wholly or in part from a dielectric material, for example by the injection moulding of plastics material which is or is not moulded on top of a metal terminal. Contrary to the terminal 3, it is slidably mounted on the conductors so that two identical terminals cover the junction zone by penetration of one half of the connecting member in the two terminals which are in end-to-end abutting relation.

To achieve this result, there is employed, if it concerns a simple prolongation, a tongue member comparable to that illustrated in FIG. 4, namely a tongue or conforming to that illustrated in FIG. 6*b*, that is to say, having a plurality of inputs if a branch connection of a plurality of conductors is to be achieved.

To take the simplest example which is that of a prolongation, the procedure is as in the first embodiment, namely the bared ends $2_1$ of the conductors 2 are inserted in the orifices $1_3$ of the connecting tongue member, then these end portions are folded under the lower face of the tongue member so as to form a labyrinth shape C. Of course, this assembly is made after having passed a terminal 4 over each conductor, the terminal sliding on the conductor by its circular orifice $4_3$. When the electrical junction has been made, the terminal is slid along the conductor until it encounters the connecting tongue member, half of which member enters each one of the considered two terminals. Note in this respect (FIG. 7) that the width "1" of the bore $4_1$ of the terminal is substantially equal to that of the connecting tongue member 1 so that the lateral edges $1_7$ of this tongue member are in frictional contact with the inner wall of this bore and a locking is produced.

In fact, it is the bent pre-stressing of the tongue member which produces the mechanical locking of the terminals on the tongue member, the lateral edges of which are jammed against the inner wall of the terminals. Therefore, at the moment of the insertion of the tongue member in the terminals, there is a certain flattening which increases the width of the tongue member and locks it in said terminal.

In the embodiment illustrated in FIG. 7, the conductors to be interconnected are of small gauge. It is possible, in respect of conductors of larger gauge as illustrated in FIG. 8, to turn the connecting tongue member 1 round so as to increase the space existing between this tongue member and the curved bottom $4_4$ of the terminal. Note in this respect that the two curves of the tongue member and terminal have substantially similar radii which improves and facilitates the centering of the conductors in the terminal.

The tongue member employed for branch connections, such as those illustrated in FIG. 6*b*, is in fact constituted by two tongue members 1 comparable to that shown in FIG. 4 or FIG. 6*a* these tongue members being bent transversely and being interconnected by a junction strip 5. The two tongue members in fact form four inputs $5_1$, $5_2$, $5_3$ and $5_4$, each of which is provided with an orifice $1_3$ having rounded edges adapted for the passage of the conductors to be connected in the form of a labyrinth shape.

The third embodiment shown in FIGS. 9 to 13 is intended for strong currents. The insulating terminal employed in this third embodiment is in every way comparable to the terminal shown in FIG. 5 and the references designating the same elements have been used in both terminals. Indeed, the sole difference between the two terminals of FIGS. 5 and 9 resides in the fact that the bottom wall $4_4$ is no longer concave but planar and comprises an indentation $4_8$ obtained by a downwardly-folded cutaway portion, this indentation being adapted to serve as a mechanical locking means for an auxiliary electric conduction member 6 shown in FIG. 12. This auxiliary electric conduction member is of course made from an electrically conductive material, in particular metal, and has a U-shaped section, the vertical branches $6_1$ of which make a right angle with a planar web $6_2$, the ends $6_3$ of these branches $6_1$ being folded inwardly at 180° to constitute support rails $6_4$ which will be applied with pressure against the connecting tongue member 7 (FIG. 11). The branches of this electric conduction auxiliary member further comprise bosses $6_5$ which project inwardly of the U and cooperate with locking notches $7_1$ formed on the connecting tongue member 7 (FIG. 11). The web $6_2$ of this member 6, which extends forwardly beyond the branches $6_1$, is provided with projecting fins $6_6$ of convex shape which promote the electric conduction therebetween and the connecting tongue member, this web $6_2$ being provided with a locking tongue member $6_7$ having a shape comparable to the indentation $4_8$ of the terminal seen in FIG. 9 so as to lock it in this terminal as illustrated in FIG. 13.

Indeed, it can be seen in this figure that the electric conduction auxiliary member 6, which acts in the manner of a clip, is inserted and locked in the terminal 4 by penetration of the tongue member $6_7$ in the indentation $4_8$ so that these two members are mechanically assembled. It is indeed necessary in the case of strong currents, for example above 2 amps, that the wire be in contact between two metal parts subjected to a certain pressure. In the present case, this double metallic contact is ensured by the connecting tongue member 7 and the metal clip 6, the pressure being produced by the fins $6_7$ which urge the bared end $2_1$ of the wire against the connecting tongue member and consequently against the rails $6_4$ formed by the bent ends $6_3$ of this auxiliary member. In this way there is obtained an excellent electric conduction between the two conductors and between the tongue member and the auxiliary member or clip, and an excellent mechanical assembly between these members, since the tongue member is trapped in the electric conduction auxiliary member by the clipping of its lateral notches $7_1$ on the bosses $6_5$ and this same member is locked in the connecting terminal 4 by cooperation of the tongue member $6_7$ in the indentation $4_8$. However, note that, in the case of strong currents, the simple tongue member (FIG. 11) or the multiple input tongue member (FIG. 10) are, contrary to those illustrated in FIGS. 4 and 6, planar. Indeed, the bending of the tongue members is insufficient to ensure in this case an excellent electrical junction and this is the reason why the auxiliary electric conduction member shown in FIG. 12 is employed in association with the tongue member 7 (FIG. 11), when it concerns a simple prolongation, or with the multiple input tongue member 8 if a branch connection is made by employing in the considered example two terminals 4 having notches $4_7$ allowing the passage of the connecting strip $8_1$ interconnecting the two tongue members $8_2$, $8_3$. It will be understood that the terminal may be directly moulded onto the clip 6 without departing from the scope of the invention.

In the embodiment illustrated in FIG. 10, the multiple input tongue member is, as opposed to that illustrated in FIG. 11, planar, and has four orifices $1_3$ for the passage of four conductors which must be electrically and mechanically interconnected. These tongue members may be easily produced from a metal sheet by a press operation which simultaneously blanks them and punches the orifices $1_3$ or the locking notches $7_1$. When the tongue members are bent, they may be bent simultaneously with or subsequent to the blanking.

As illustrated in FIG. 14, the connecting terminals may be produced in series of two, three or more terminals interconnected by junction portions 9 which may be easily cut or broken. In this case, the two end terminals advantageously have on their lateral edges 10 a dovetail tenon 11 or mortise 12 which permits the addition of individual terminals or assemblies of terminals comparable to the assembly shown in FIG. 14. Such assemblies may be desirable in particular in the case of branch connections. It is obvious that the multiple input connecting tongue member will be chosen in accordance with the number of terminals to be connected. In this respect, the connecting tongue members may have more than four inputs and may even be constructed in the form of a strip which has multiple inputs and is cut to length in accordance with the number of conductors to be connected. In fact, the insulating terminal constitutes a module which may be multiplied, as desired, depending on the type of connection to be made.

The fixing device according to any one of the three aforementioned embodiments has the advantage of being highly reliable, owing to the fact that it achieves an electrical junction and a particularly effective mechanical assembly between at least two conductors. The electric conduction is advantageously affected by the labyrinth shape of the bared end of the conductors in the orifices of the connecting tongue member, since the contact which occurs in the region of the two bends of the labyrinth shape of each conductor enables the surface of contact between said conductor and the connecting tongue member to be notably increased. Furthermore, this device has a high resistance to pulling forces and the introduction of the connecting tongue member in the terminal, or vice versa, enables the conductor to be immediately immobilized in its position of electrical contact.

It must be understood that the invention is not intended to be limited to the embodiments described hereinbefore, since other embodiments or other forms of tongue members or insulating terminals may be envisaged without departing from the scope of the invention.

Having now described our invention what we claim as new and desire to secure by Letters Patent is:

1. A connecting device in combination with and achieving an electrical junction and a mechanical assembly of two conductors, each conductor having at least one strand of wire and a bared wire end portion, said device comprising in combination an elongate electrically conductive connecting member substantially in the shape of a strip which defines two opposed side surfaces and a peripheral edge and two throughway orifices which are spaced apart from each other longitudinally of the strip, the bared end portions of the two conductors being respectively combined with the two orifices in contact zones between the strip and the bared end portions, each bared end portion comprising in the corresponding contact zone an extremity part extending substantially longitudinally alongside and adjoining a first of said surfaces of the strip, a second part extending substantially longitudinally alongside and adjoining a second of said surfaces of the strip and a third part interconnecting said extremity part and said second part and transversely extending through the respective orifice of said two orifices and imparting a labyrinth shape to the bared end portion, two tubular insulating terminals surrounding opposite end portions of the strip and covering said contact zones, each terminal defining with said first surface a first cavity receiving said extremity part of the bared end portion of the corresponding conductor and defining with said second surface a second cavity receiving said second part of the bared end portion of the corresponding conductor, means interposed between the terminals and the strip for slidingly mounting the terminals longitudinally on the strip, retaining means interposed between the terminals and the strip for retaining the terminals on the strip, longitudinally extending support means in said first cavity of each terminal in supporting contact with said extremity part of the bared end portion of the corresponding conductor, one of two elements consisting of the strip and the support means of each terminal being resiliently yieldable and in a condition in which it is resiliently stressed transversely of said first cavity in a direction away from the other of said elements by the extremity part of the bared end portion of the corresponding conductor for maintaining electrical contact between the strip and the corresponding bared end portion.

2. A device as claimed in claim 1, wherein the strip is a flat metal strip, the orifices have a diameter slightly larger than the diameter of the bared end portion of the conductors, two lateral portions of said peripheral edge of the strip define locking notches, and bosses which are complementary with the notches project inside the tubular insulating terminals and cooperate with said notches and constitute said retaining means.

3. A device as claimed in claim 1, wherein the strip is slightly bent transversely of the strip.

4. A device as claimed in claim 1, wherein the strip defines at least two transverse slots which facilitate said resiliently yielding by torsion.

5. A device as claimed in claim 1, wherein the strip is combined with a second identical strip extending substantially longitudinally parallel to the first strip and connected thereto by junction parts and said strips are flat metal strips, two lateral portions of said peripheral edge of each strip define locking notches, and bosses which are complementary with the notches project inside the tubular insulating terminals and cooperate with said notches and constitute said retaining means.

6. A device as claimed in claim 5, wherein said two strips constitute a strip assembly which is slightly bent transversely of the assembly.

7. A device as claimed in claim 1, wherein the strip is transversely bent before assembly with the terminals and is transversely in position of the terminals for accommodating conductors of different cross-sectional sizes.

8. A connecting device achieving the electrical junction and the mechanical assembly of at least two single-strand or multi-strand conductors of various gauges having bared ends, said device comprising a connecting member having at least two inputs respectively provided with at least two orifices in which orifices the bared ends of the conductors are engaged to form a labyrinth shape, at least one terminal in the form of a cylindrical at least partly insulating sleeve having a bore mounted on the connecting member and covering the bared end of the two conductors, the bore being provided with two inner shoulders which extend longitudinally of the sleeve in a substantially diametral plane of the sleeve, said shoulders resulting from a difference between radii of two portions of the bore each of which portions extends circumferentially in one half of the bore, the portion having the larger radius extending only in a part of the length of the sleeve and thereby defining a radial abutment limiting the depth of insertion of the connecting member in the sleeve.

9. A device as claimed in claim 8, wherein the inner shoulders are inclined with respect to a diametral plane of the sleeve so as to perfect the anchoring of the connecting member in said sleeve.

10. A device as claimed in claim 8, wherein the sleeve is of conductive material and a dielectric sheath is integral with the sleeve and insulates the outside of the sleeve.

11. A device as claimed in claim 1, wherein each tubular insulating terminal has a substantially parallel-sided shape and defines internally a bore extending longitudinally of the terminal and having a rectangular cross-sectional shape transversely of the terminal, the bore having a width and the strip having a width which are equal, the bore having a bottom wall which is slightly incurvate in a transverse plane of the bore, and the terminal having a front end face which intersects the bottom wall of the bore on an edge curved longitudinally of the terminal.

12. A device as claimed in claim 11, wherein each tubular insulating terminal has a rear end portion which defines a circular orifice which opens onto said bore.

13. A device as claimed in claim 5, wherein each tubular insulating terminal has a front end face defining notches on two lateral sides of said front end face for the passage of said junction parts.

14. A device as claimed in claim 1, wherein each tubular insulating terminal has a substantially parallel-sided shape and defines internally a bore extending longitudinally of the terminal and having a rectangular cross-sectional shape transversely of the terminal, the bore having a bottom wall which is flat, and the terminal having a front end face which intersects the bottom wall of the bore on an edge curved longitudinally of the terminal, the device further comprising, associated to each terminal, an auxiliary electric conduction member, and said bottom wall of said associated terminal having an indentation cooperative with the auxiliary member for locking the auxiliary member.

15. A device as claimed in claim 14, wherein said auxiliary electric conduction member is constituted by a transversely U-shaped metal clip having a web extending longitudinally to the associated terminal and two branches connected to said web, which branches are bent inwardly at 180° to constitute support rails which are cooperative with to exert pressure on said strip, the web of said clip being forwardly extended, longitudinally to said web, by a locking tongue capable of being anchored in said indentation to render the clip integral with the terminal, said web having slightly projecting transverse fins for improving the electrical contact between the clip and the connecting member.

16. A device as claimed in claim 15, wherein the strip is combined with a second identical strip extending substantially longitudinally parallel to the first strip and connected thereto by junction parts and said strips are flat metal strips, two lateral portions of said peripheral edge of each strip define locking notches, and said branches of the metal clip have inner bosses which are cooperative with the locking notches of the connecting member and constitute said retaining means.

17. A device as claimed in claim 14, wherein the terminal is mouled onto the auxiliary member so that the terminal is strictly spatially integral with the auxiliary member.

18. A connecting device in combination with and achieving an electrical junction and a mechanical assembly of two conductors, each conductor having at least one strand of wire and a bared wire end portion, said device comprising in combination an elongate electrically conductive connecting member substantially in the shape of a strip of sheet material which defines two opposed side surfaces and a peripheral edge and two throughway orifices which are spaced apart from each other longitudinally of the strip, the bared end portions of the two conductors being respectively combined with the two orifices in contact zones between the strip and the bared end portions, each bared end portion comprising in the corresponding contact zone an extremity part extending substantially longitudinally alongside and adjoining a first of said surfaces of the strip, a second part extending substantially longitudinally alongside and adjoining a second of said surfaces of the strip and a third part interconnecting said extremity part and said second part and transversely extending through the respective orifice of said two orifices and imparting a labyrinth shape to the bared end portion, two tubular insulating terminals surrounding opposite end portions of the strip and covering said contact zones, each terminal defining with said first surface a first cavity receiving said extremity part of the bared end portion of the corresponding conductor and defining with said second surface a second cavity receiving said second part of the bared end portion of the corresponding conductor, means interposed between the terminals and the strip for slidingly mounting the terminals longitudinally on the strip, said first cavity of each terminal defining a longitudinally extending and transversely extending support face in supporting contact with said extremity part of the bared end portion of the corresponding conductor, two abutment means provided on each terminal and cooperative with the strip adjacent transversely opposed portions of said peripheral edge of the strip to subject the strip to transverse bending stress and maintain the strip applied against the extremity part of the corresponding bared end portion and thereby maintain an electrical contact and frictionally retain the terminal on the strip.

19. A device as claimed in claim 18, wherein said support face is curved and concave transversely of the strip.

20. A device as claimed in claim 18, wherein the strip is transversely curved before assembly with the terminals and said first surface is the convex side of the strip when the terminals are mounted thereon, whereby said transverse bending stress tends to flatten the strip and cause it to be wedged against the terminals in the region of said abutments.

21. A device as claimed in claim 1, further comprising a second strip identical to and substantially parallel to the first-mentioned strip, a junction strip interconnecting the two strips, the three strips defining a substantially H-shaped structure for use with said two terminals together with two further terminals identical to the first-mentioned terminals and two further conductors, the terminals defining lateral passages through which said junction strip extends.

* * * * *